US011193661B2

(12) United States Patent
Hou et al.

(10) Patent No.: US 11,193,661 B2
(45) Date of Patent: Dec. 7, 2021

(54) LIGHTING APPARATUS

(71) Applicant: XIAMEN LEEDARSON LIGHTING CO., LTD, Fujian (CN)

(72) Inventors: Shouqiang Hou, Fujian (CN); Yizhen Chen, Fujian (CN); Wenjin Peng, Fujian (CN); Xiaoliang Wen, Fujian (CN)

(73) Assignee: XIAMEN LEEDARSON LIGHTING CO., LTD, Xiamen (CN)

( * ) Notice: Subject to any disclaimer, the term of this patent is extended or adjusted under 35 U.S.C. 154(b) by 0 days.

(21) Appl. No.: 16/952,546

(22) Filed: Nov. 19, 2020

(65) Prior Publication Data

US 2021/0148557 A1 May 20, 2021

(30) Foreign Application Priority Data

Nov. 19, 2019 (CN) ..... 201922006081.7
Nov. 19, 2019 (CN) ..... 201922006085.5

(51) Int. Cl.

| | |
|---|---|
| ***F21V 23/04*** | (2006.01) |
| ***F21V 23/00*** | (2015.01) |
| ***F21V 17/10*** | (2006.01) |
| ***F21V 3/00*** | (2015.01) |
| ***F21V 23/06*** | (2006.01) |
| *F21Y 115/10* | (2016.01) |

(52) U.S. Cl.

CPC ..... *F21V 23/0442* (2013.01); *F21V 3/00* (2013.01); *F21V 17/104* (2013.01); *F21V 23/007* (2013.01); *F21V 23/06* (2013.01); *F21Y 2115/10* (2016.08)

(58) Field of Classification Search

CPC ..... F21V 23/0442; F21V 3/00; F21V 17/104; F21V 23/007; F21V 23/06; F21V 37/0095

See application file for complete search history.

(56) References Cited

U.S. PATENT DOCUMENTS

| | | | | |
|---|---|---|---|---|
| D288,967 S * | 3/1987 | Naft | ..... | D26/26 |
| 5,727,953 A * | 3/1998 | Pasholk | ..... | F21S 8/035 439/21 |
| 5,954,519 A * | 9/1999 | Hsiao | ..... | F21S 8/035 439/21 |
| 6,022,128 A * | 2/2000 | Chi | ..... | F21S 8/035 362/276 |

(Continued)

*Primary Examiner* — Bryon T Gyllstrom
*Assistant Examiner* — Christopher E Dunay
(74) *Attorney, Agent, or Firm* — Chun-Ming Shih; Lanway IPR Services

(57) ABSTRACT

A lighting apparatus includes a light source module, a driver, an electrical pin, a neck structure, a light passing cover and a base container. The light source module includes a LED module. The driver converts an external power source to a driving current supplied to the LED module. The electrical pin is to be plugged to an electrical socket to connect to the external power source. The neck structure has a light opening and a buckle groove. The light passing cover has a connector attached to the buckle groove. A light is emitted from the LED module passes through the light opening to the light passing cover. The base container contains the light source module and the driver. The base container fixes the electrical pin to have an exposed portion to be inserted to the electrical socket.

19 Claims, 8 Drawing Sheets

(56) References Cited

U.S. PATENT DOCUMENTS

| | | | | |
|---|---|---|---|---|
| 6,488,510 | B2 * | 12/2002 | Li | H01R 35/04 362/649 |
| D524,456 | S * | 7/2006 | Yuen | D26/26 |
| 2006/0007709 | A1 * | 1/2006 | Yuen | F21S 8/035 362/641 |
| 2006/0115386 | A1 * | 6/2006 | Michaels | F21S 10/04 422/123 |
| 2006/0171141 | A1 * | 8/2006 | Tsai | F21V 23/0407 362/95 |
| 2006/0221617 | A1 * | 10/2006 | Chien | F21S 10/002 362/295 |
| 2007/0242485 | A1 * | 10/2007 | Chien | H04N 5/2252 362/643 |
| 2007/0253222 | A1 * | 11/2007 | Driska | G09F 13/04 362/641 |
| 2008/0074873 | A1 * | 3/2008 | Lin | F21S 8/035 362/235 |
| 2010/0290254 | A1 * | 11/2010 | Howard | F21S 8/035 362/641 |
| 2014/0185325 | A1 * | 7/2014 | Howard | F21S 8/035 362/641 |
| 2016/0195257 | A1 * | 7/2016 | Hsiao | F21S 8/035 362/92 |
| 2019/0242537 | A1 * | 8/2019 | Wang | H02J 7/0068 |

* cited by examiner

LIGHTING APPARATUS

FIELD

The present invention is related to a lighting apparatus, and more particularly related to a lighting apparatus conveniently used in night time.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

In the night time, people still need certain illumination. However, the light may also affect people to sleep well.

Sometimes, people will get up in darkness, and a smart lighting is very helpful on such situation.

It is beneficial to design a flexible and convenient solution for such purposes.

SUMMARY

In some embodiments, a lighting apparatus includes a light source module, a driver, an electrical pin, a neck structure, a light passing cover and a base container.

The light source module includes a LED module.

The driver converts an external power source to a driving current supplied to the LED module.

The electrical pin is to be plugged to an electrical socket to connect to the external power source.

The neck structure has a light opening and a buckle groove.

The light passing cover has a connector attached to the buckle groove.

A light is emitted from the LED module passes through the light opening to the light passing cover.

The base container contains the light source module and the driver.

The base container fixes the electrical pin to have an exposed portion to be inserted to the electrical socket. The base container fixes the neck structure at an exterior surface of the base container.

In some embodiments, a first direction for the electrical pin inserting to the electrical socket is perpendicular to a second direction for the LED module to emit the light passing through the light opening.

In some embodiments, the base container has a front cover and a back cover. The electrical pin is disposed on the back cover.

In some embodiments, the neck structure has a first neck part and a second neck part.

The first neck part is disposed on the front cover and the second neck part is disposed on the back cover.

When the front cover is fixed to the back cover, the first neck part engages the second neck part together forming the buckle groove.

In some embodiments, the first neck part has a first lens groove.

The second neck part has a second lens groove.

When the first neck part engages the second neck part, the first lens groove and the second lens groove together form the light opening and clip a lens at the light opening.

In some embodiments, the neck structure is detachably attached to the base container.

In some embodiments, the driver is located on a first circuit board.

The electrical pin is fixed to the first circuit board.

The LED module is located on a second circuit board.

The first circuit board is perpendicularly fixed to the second circuit board.

In some embodiments, the light passing cover has multiple protruding bars in an inner surface of the light passing cover.

A width of the protruding bar is smaller than a distance between adjacent protruding bars.

In some embodiments, the light passing cover has multiple protruding bars in an inner surface of the light passing cover.

A width of the protruding bar is larger than a distance between adjacent protruding bars.

In some embodiments, a transparent cover is fixed to the light opening.

The transparent cover and the base container together conceal the driver and the light source module.

In some embodiments, the transparent cover is a lens for guiding the light of the LED module into the light passing cover.

In some embodiments, the lens is a diffusion lens.

In some embodiments, the base container has a rotation structure for rotating the base container with respect to the electrical pin.

In some embodiments, the lighting apparatus may also include a manual switch disposed on the base container for remote controlling another light device.

In some embodiments, the lighting apparatus may also include an extending socket for inserting a function module.

The function module is electrically connected to the driver.

In some embodiments, there is a reflective layer disposed at a firs side inside the light passing cover to reflect the light of the LED module to a second side of the light passing cover.

In some embodiments, the light passing cover has an identifier unit.

When the light passing cover is attached to the neck structure, the driver determines a setting according to the identifier unit to control the LED module.

In some embodiments, the identifier unit is an electronic device to indicate the driver to change the setting for controlling the LED module.

In some embodiments, the identifier unit is a structure device to trigger a switch connected to the driver to change the setting for controlling the LED module.

In some embodiments, the passing cover has a back opening facing to a third direction in parallel to a first direction the electrical pin is inserted to the electrical socket.

In some embodiments, the neck structure has an electrode for routing electricity to a second light source disposed on the light passing cover.

In some embodiments, the base container has a sensor opening on a front surface for a sensor connected to the driver to determine a setting based on detected data of the sensor.

DETAILED DESCRIPTION

Figure 1:
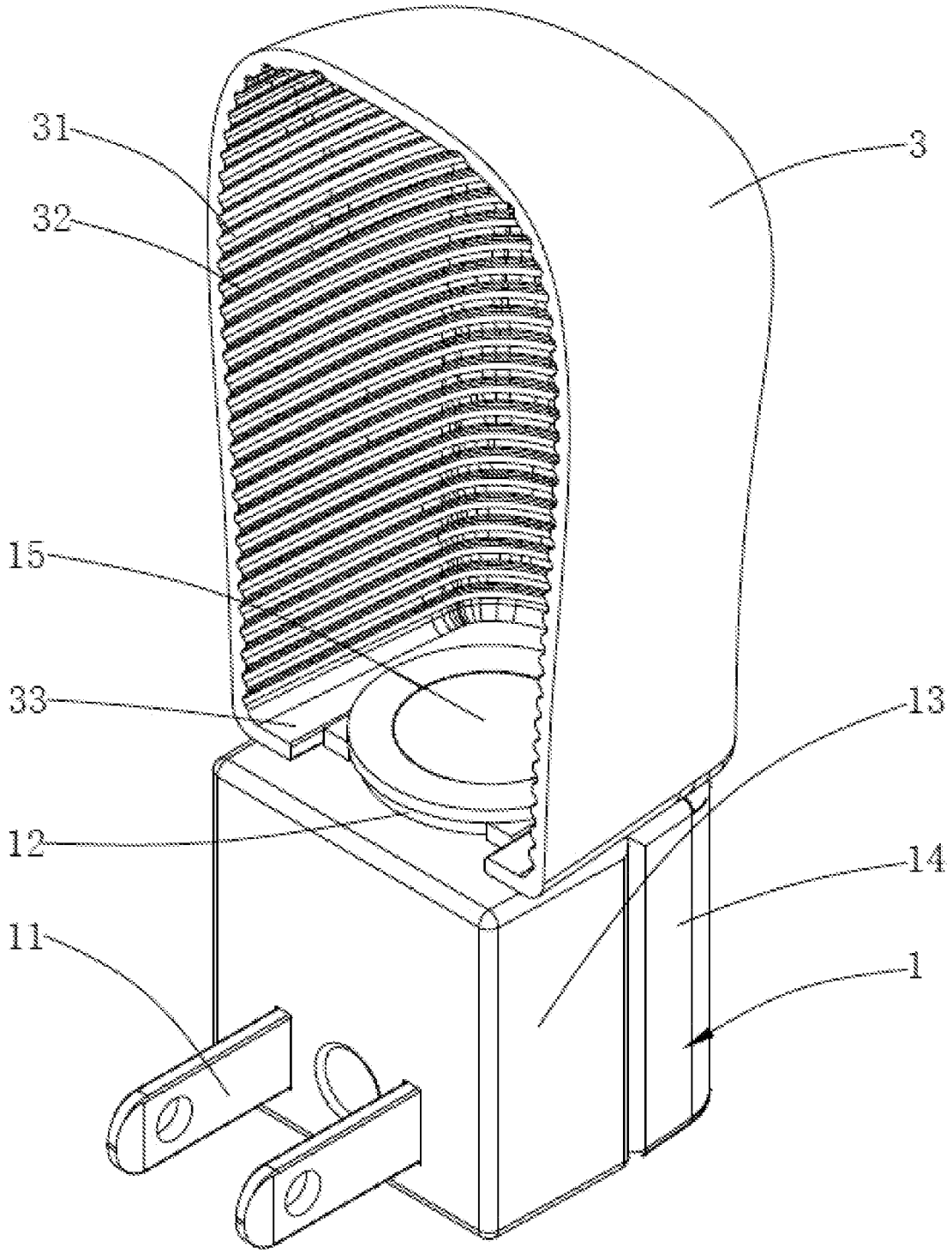
FIG. 1 illustrates a lighting apparatus embodiment.

In some embodiments, a lighting apparatus includes a light source module 662, a driver 663, an electrical pin 664, a neck structure 665, a light passing cover 666 and a base container 661.

The light source module 662 includes a LED module 667.

The driver 663 converts an external power source 668 to a driving current supplied to the LED module 667. In some embodiments, the external power source 668 is an indoor alternating current power, e.g. 110V/220V alternating current source. The driver 663 has a rectifier for converting the alternating current to a direct current and performs certain filtering and even chopping to generate a proper driving current to the LED module 662. In addition, the driver 663 may contain control logic to generate control signals or change driving currents to change output parameters of the LED module 667.

The LED module 667 may have multiple LED chips of different types so as to mix lights of required parameters like required color temperatures, colors or other parameters.

The driver 663 may also include communication circuits like Bluetooth wireless circuit for receiving an external command for controlling the LED module according to the external command. Other sensors may be integrated with the driver 663 for the driver 663 to act smartly according to detected results. More detail examples are provided below.

The electrical pin 664 is to be plugged to an electrical socket 669 to connect to the external power source 668.

The neck structure 665 has a light opening 6651 and a buckle groove 6652. The light opening is an opening for a light emitted from the LED module 667 to pass through to enter the light passing cover 666.

The light passing cover 666 has a connector 6661 attached to the buckle groove 6652.

A light is emitted from the LED module 667 passes through the light opening 6651 to the light passing cover 666.

The base container 661 contains the light source module 662 and the driver 663. For example, the base container 661 is made of a plastic housing defining a container space for storing the light source module 662 and the driver 663. The plastic housing may have related positioning structures so that the driver 663 and the light source module 662 are fixed at predetermined positions and the light emitted by the LED module 667 is aligned with the light opening 6651.

The base container 661 fixes the electrical pin 664 to have an exposed portion 6641 to be inserted to the electrical socket 669. For example, the electrical pin 664 is connected to electrodes of the driver 663 and positioned by a structure of the plastic housing mentioned above to keep the electrical pin 664 stable. The base container 663 fixes the neck structure 665 at an exterior surface of the base container 663.

There are several different ways to fix the neck structure 665 to the base container 663.

Figure 7A:
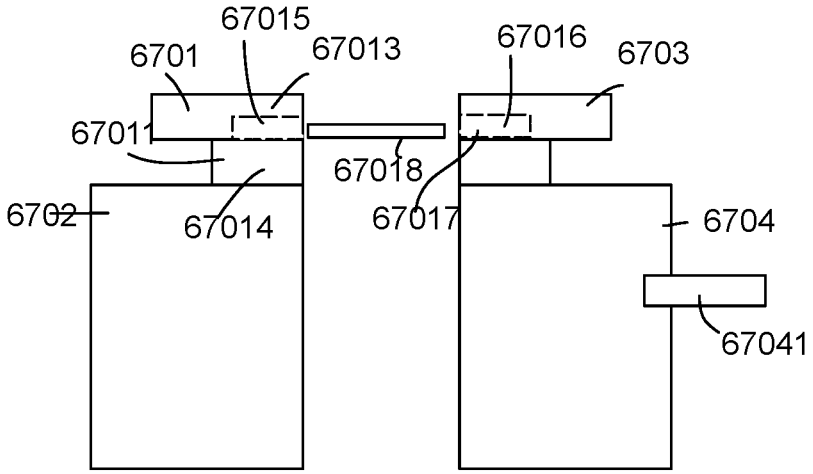
FIG. 7A shows a first way to produce the base container.

Please refer to FIG. 7A. In FIG. 7A, the neck structure has a first neck part 6701 mounted on a front cover 6702. The neck structure also has a second neck part 6703 mounted on a back cover 6704.

There is a fixing structure, e.g. a buckle structure or a screw, to fix the front cover 6702 to the back cover 6704. Before the front cover 6702 is fixed to the back cover 6704, the driver may be placed inside the base container. In addition, when the front cover 6702 engages the back cover 6704, the first neck part 6701 also engages the second neck part 6703 forming a complete neck structure.

In the example of FIG. 7A, the front cover 6702 and the first neck part 6701 may be made together as one-piece unit, e.g. being produced by a single molding procedure. The back cover 6704 and the second neck part 6703 may be produced similar to the front cover 6702 and the first neck part 6701.

Figure 7B:
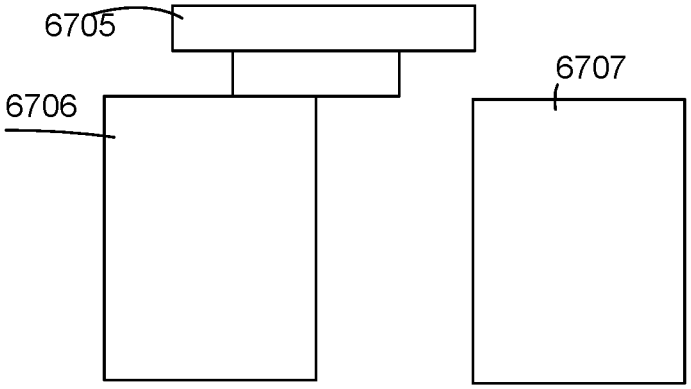
FIG. 7B shows a second way to produce the base container.

FIG. 7B shows a different way to implement the base container. In FIG. 7B, the base container is formed with a front cover 6706 and a back cover 6706, similar as the example of FIG. 7A. However, the neck structure 6705 is integrated to the front cover 6706.

Figure 7C:
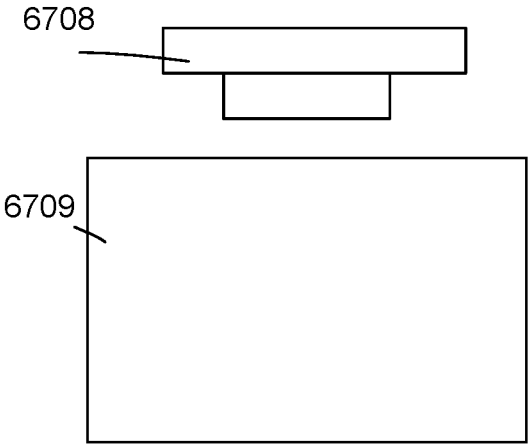
FIG. 7C shows a third way to produce the base container.

FIG. 7C shows another way to implement the base container. In FIG. 7C, the neck structure 6708 is made as a separate module to be inserted to the base container 6709.

In some embodiments, a first direction 6681 for the electrical pin 664 inserting to the electrical socket 669 is perpendicular to a second direction 6682 for the LED module 667 to emit the light passing through the light opening 6651.

In FIG. 7A, the base container has a front cover 6702 and a back cover 6704. The electrical pin 67041 is disposed on the back cover 6704.

In FIG. 7A, the neck structure 6701 has a first neck part 6701 and a second neck part 6703.

The first neck part 6701 is disposed on the front cover 6702 and the second neck part 6703 is disposed on the back cover 6704.

When the front cover 6702 is fixed to the back cover 6704, the first neck part 6701 engages the second neck part 6703 together forming the buckle groove 67011.

The buckle groove 67011 is formed by disposing an enlarged head 67013 with a relative narrower neck portion 67014.

In FIG. 7A, the first neck part 6701 has a first lens groove 67015.

The second neck part 6703 has a second lens groove 67016.

When the first neck part 6701 engages the second neck part 6703, the first lens groove 67015 and the second lens groove 67016 together form the light opening 67017 and clip a lens 67018 at the light opening 67017, e.g. clipping and fixing the lens 67018 in the lens groove of the lens grooves 67015, 67016.

In FIG. 7C, the neck structure 6708 is detachably attached to the base container 6709.

Figure 3:
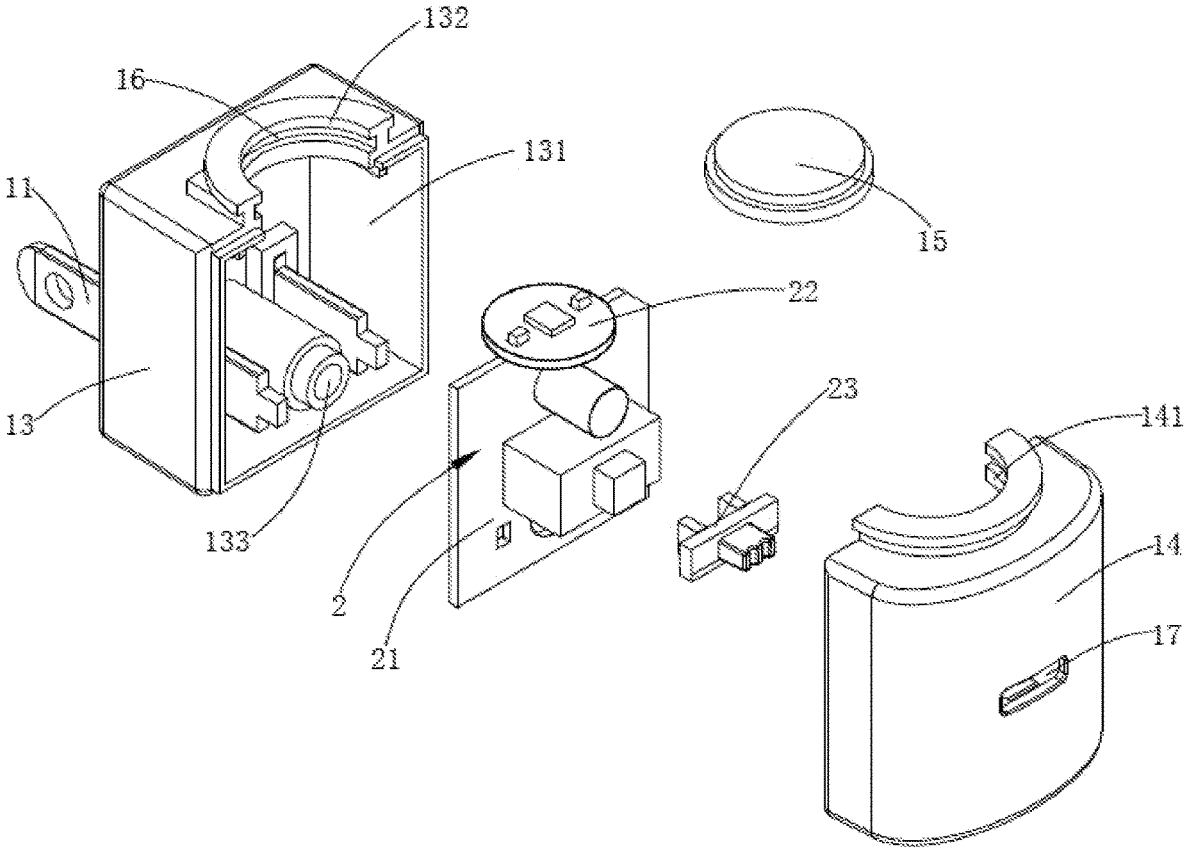
FIG. 3 illustrates an exploded view of components in the example of FIG. 1.

In FIG. 3, the driver 2 is located on a first circuit board 21.

The electrical pin 11 is fixed to the first circuit board 21.

The LED module 22 is located on a second circuit board 221.

The first circuit board 21 is perpendicularly fixed to the second circuit board 221.

In FIG. 1, the light passing cover 3 has multiple protruding bars 31 in an inner surface of the light passing cover 3.

In some embodiments, a width 311 of the protruding bar 31 is smaller than a distance 32 between adjacent protruding bars. Such arrangement makes output light more shining and stronger on contrast.

In other embodiments, the light passing cover has multiple protruding bars in an inner surface of the light passing cover.

A width 311 of the protruding bar 31 is larger than a distance 32 between adjacent protruding bars. Such arrangement makes the output light smoother.

In some embodiments, a transparent cover is fixed to the light opening.

The transparent cover and the base container together conceal the driver and the light source module. For example, in the example of FIG. 7A, the lens 67018 is a transparent cover together with the front cover 6702 and the back cover 6704 forming a concealing space for concealing the driver and the light source module. In other words, users do not have the danger to touch the electronic component of the lighting apparatus. The light emitted from the LED module passes through the transparent cover, instead of being exposed to users.

In some embodiments, the transparent cover is a lens for guiding the light of the LED module into the light passing cover.

In some embodiments, the lens is a diffusion lens so as to diffusing light evenly to the inner side of the light passing cover.

Figure 6:
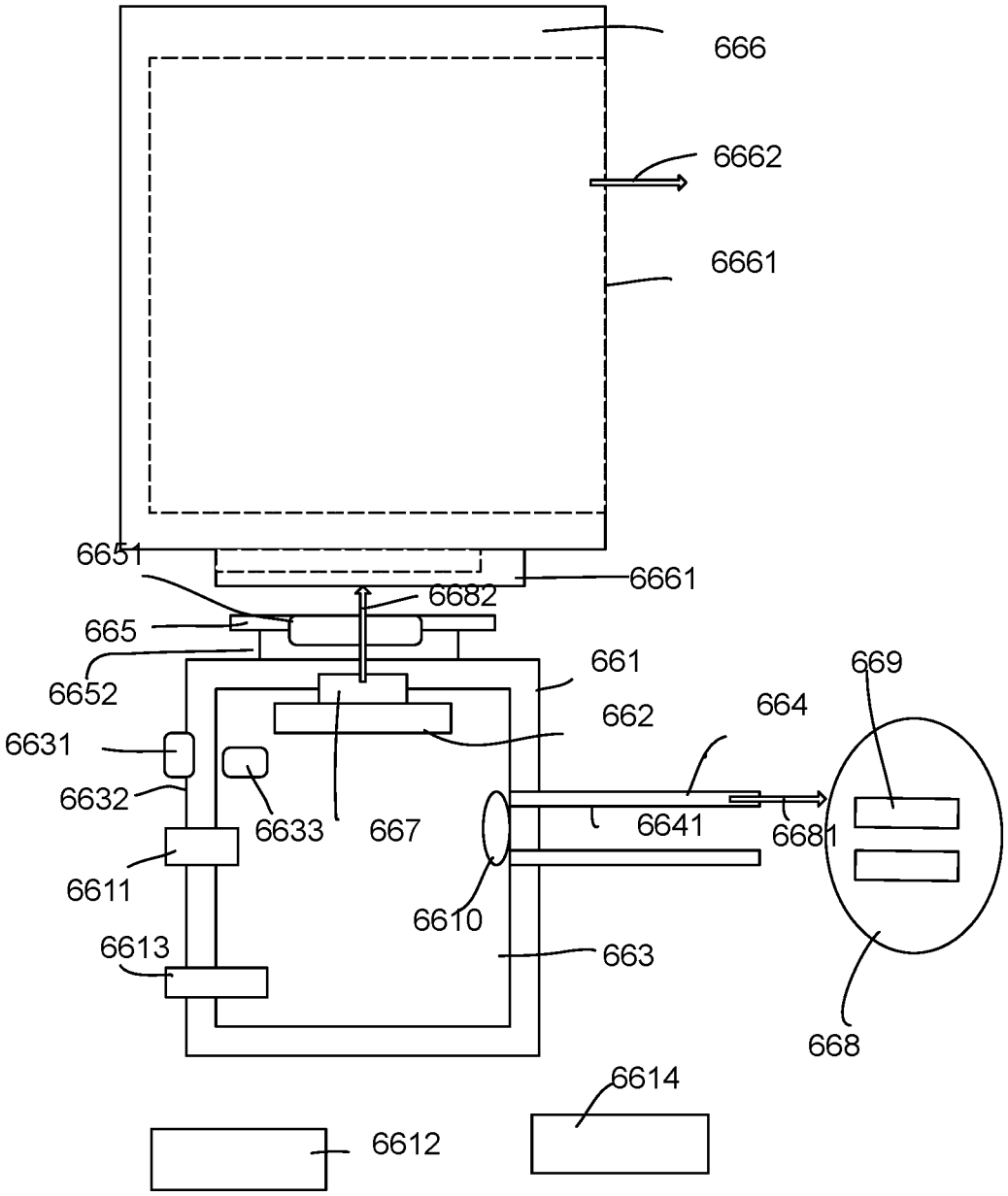
FIG. 6 shows another embodiment.

In FIG. 6, the base container has a rotation structure 6610 for rotating the base container 663 with respect to the electrical pin 664.

In some embodiments, the lighting apparatus may also include a manual switch 6611 disposed on the base container 663 for remote controlling another light device 6612. For example, the driver 663 may include a wireless circuit connecting to the external light device 6612 via a wireless interface and sends control commands, e.g. changing color temperature, turning on/off to the external light device 6612.

In some embodiments, the lighting apparatus may also include an extending socket 6613 for inserting a function module 6614, e.g. a speaker, a wireless module, a Wi-Fi hotspot device, a sensor.

The function module 6614 is electrically connected to the driver 663, e.g. sharing the converted power of the driver 663.

Figure 8:
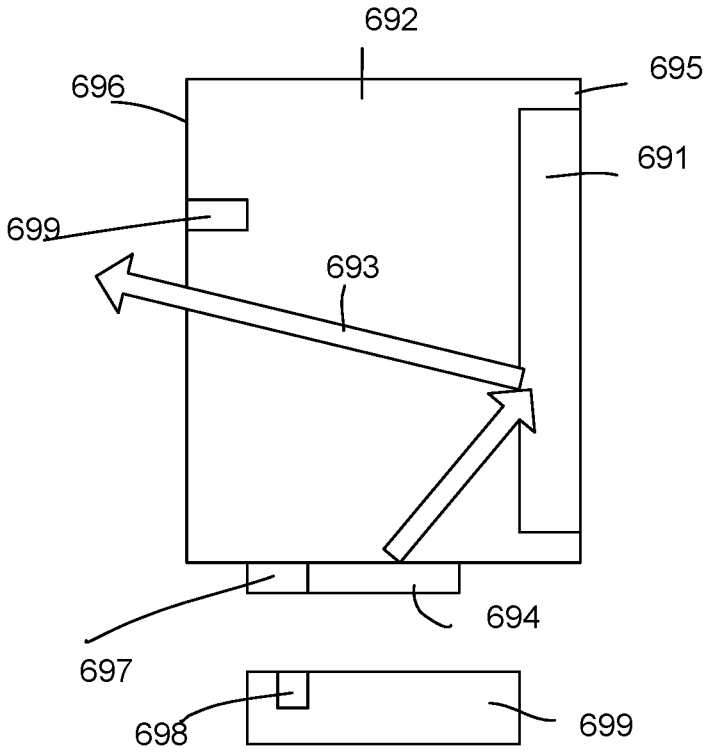
FIG. 8 shows a reflective layer disposed inside the light passing cover.

In FIG. 8, there is a reflective layer 691 disposed at a firs side 695 inside the light passing cover 692 to reflect the light 693 of the LED module 694 to a second side 696 of the light passing cover 692.

In some embodiments, the light passing cover 692 has an identifier unit 697. The identifier unit 697 may be an electronic component indicating the driver the type of the light passing cover or a structure component triggering a mechanical movement that invokes a message to the driver to indicate the driver the type of the light passing cover.

When the light passing cover is attached to the neck structure, the driver determines a setting according to the identifier unit to control the LED module.

In some embodiments, the identifier unit is an electronic device to indicate the driver to change the setting for controlling the LED module.

In some embodiments, the identifier unit is a structure device to trigger a switch connected to the driver to change the setting for controlling the LED module.

In FIG. 6, the passing cover 666 has a back opening 6661 facing to a third direction 6662 in parallel to a first direction 6681 the electrical pin 664 is inserted to the electrical socket 669.

In FIG. 8, the neck structure 699 has an electrode 698 for routing electricity to a second light source 699 disposed on the light passing cover 692.

In FIG. 6, the base container has a sensor opening 6631 on a front surface 6632 for a sensor 6633 connected to the driver 663 to determine a setting based on detected data of the sensor 6633.

Please refer to FIG. 1. FIG. 1 illustrates a lighting apparatus. The lighting apparatus has a light passing cover 3. There are multiple protruding bars 31 disposed at inner surface of the light passing cover 3.

The lighting apparatus also has a base container 1 that is formed with a front cover 14 and a back cover 13. There are a pair of electrical pins 11 connecting to an electrical socket.

There is a buckle groove 12 for the connector 33 of the light passing cover 3 to fix the light passing cover 3 to the base container 1.

The neck structure also has a lens as a transparent cover covering a light opening of the neck structure.

Figure 2:
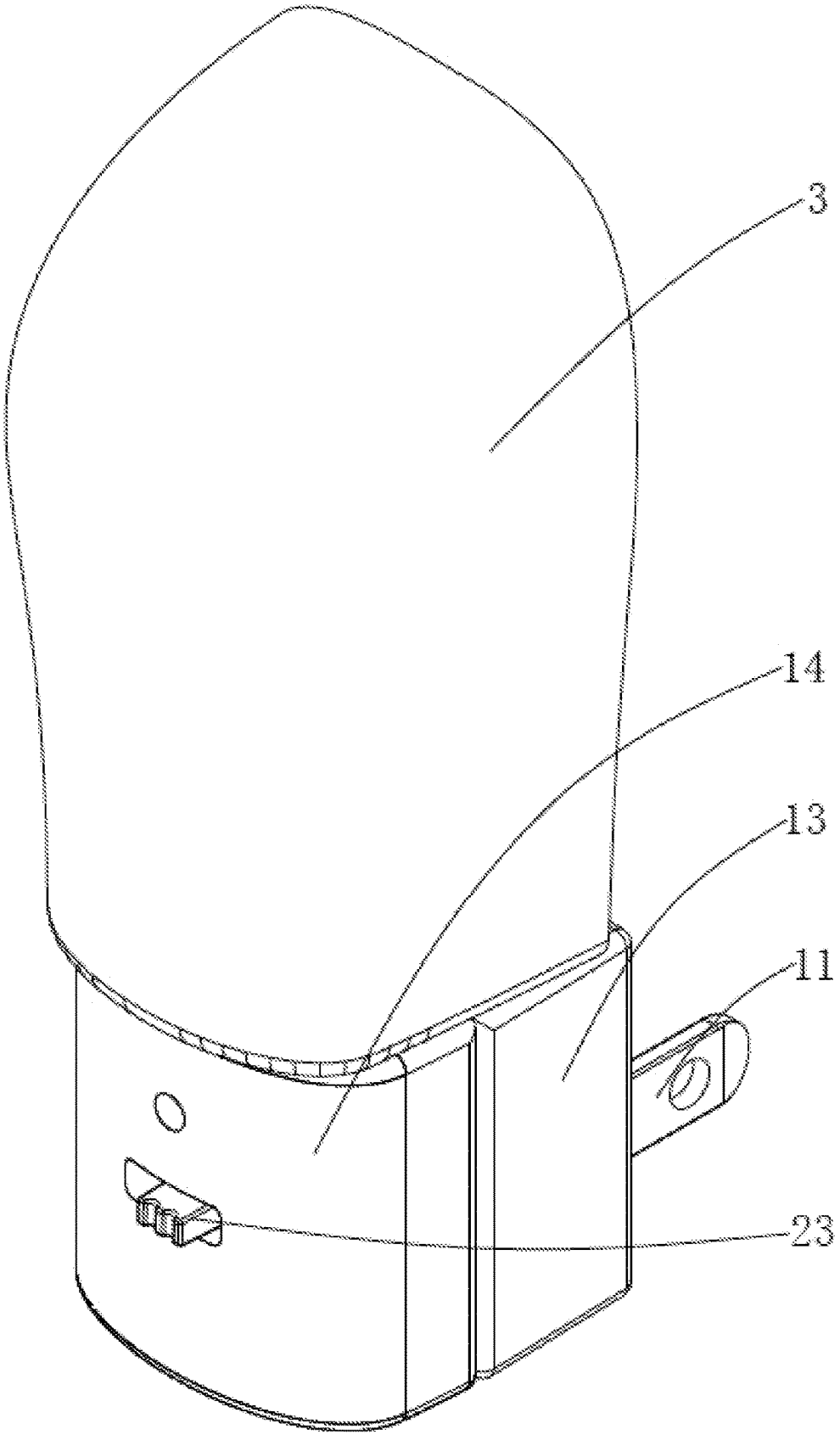
FIG. 2 illustrates another view of the example in FIG. 1.

FIG. 2 shows another view of the example in FIG. 1.

In FIG. 2, the front cover 14 also has a manual switch 23 for adjusting control of the lighting apparatus or to control another connected external device, as an example mentioned above.

The same reference numerals refer to the same components. If they are described and explained, some are not repeated again for brevity.

In FIG. 3, an exploded view of the example in FIG. 1 is provided.

The LED module 22 is placed on a second circuit board 221. The driver 2 has a first circuit board 21. The manual switch 23 is disposed on the first circuit board 21. The front cover 14 has a first neck part 141. The back cover 13 has a second neck part 132. The first neck part 141 and the second neck part 142 together form the buckle groove for attaching the light passing cover. There is a lens groove 16 for inserting and fixing the lens 15.

There is positioning column 133 on the base container for positioning components like the first circuit board 21. An operation hole 17 is used for the manual switch 23 to expose to user to operate.

Figure 4:
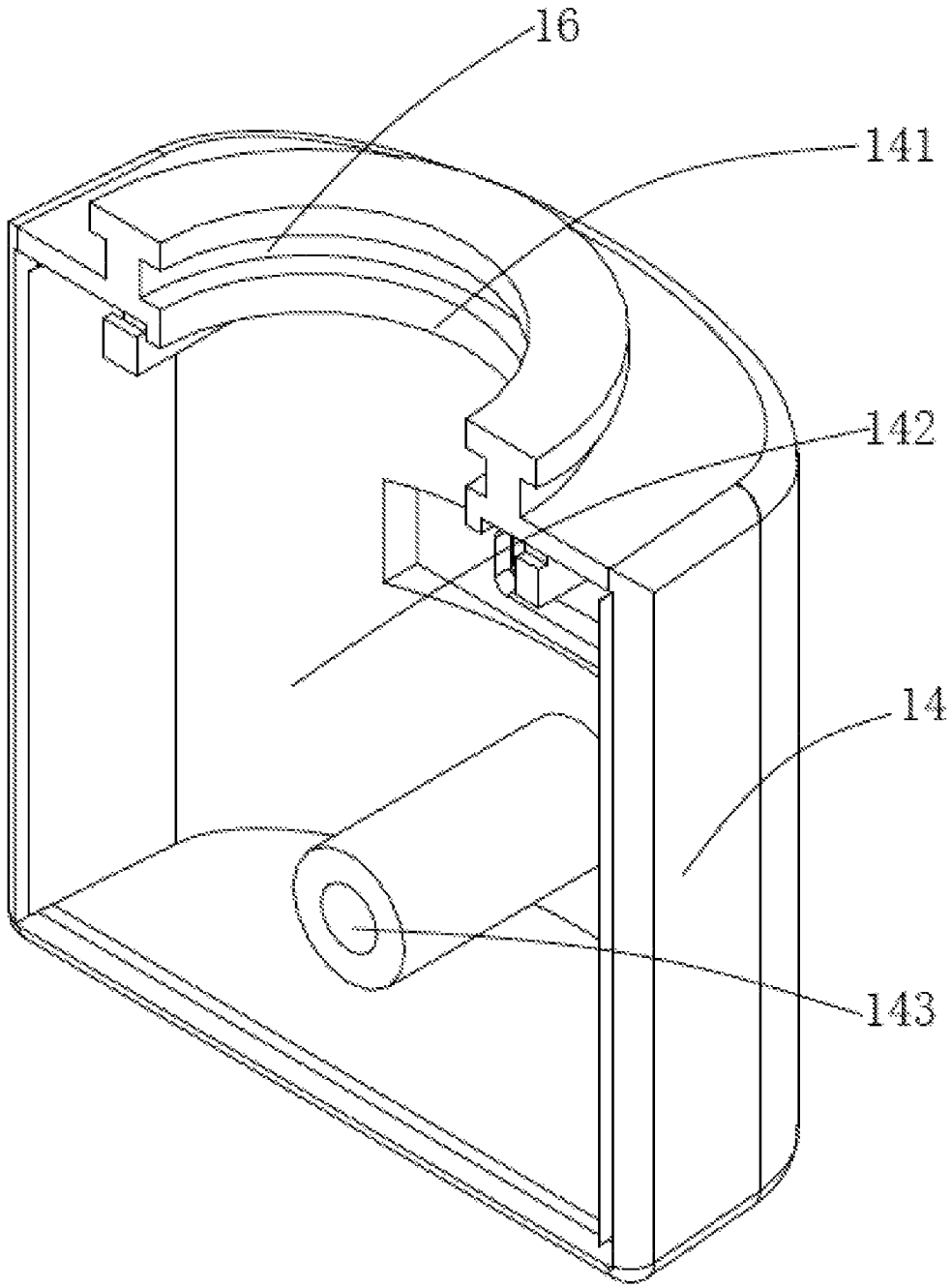
FIG. 4 illustrates a front cover example.

FIG. 4 additionally show a container space 142 provided by the front cover 14 and there is another positioning column 143 used for positioning components.

Figure 5:
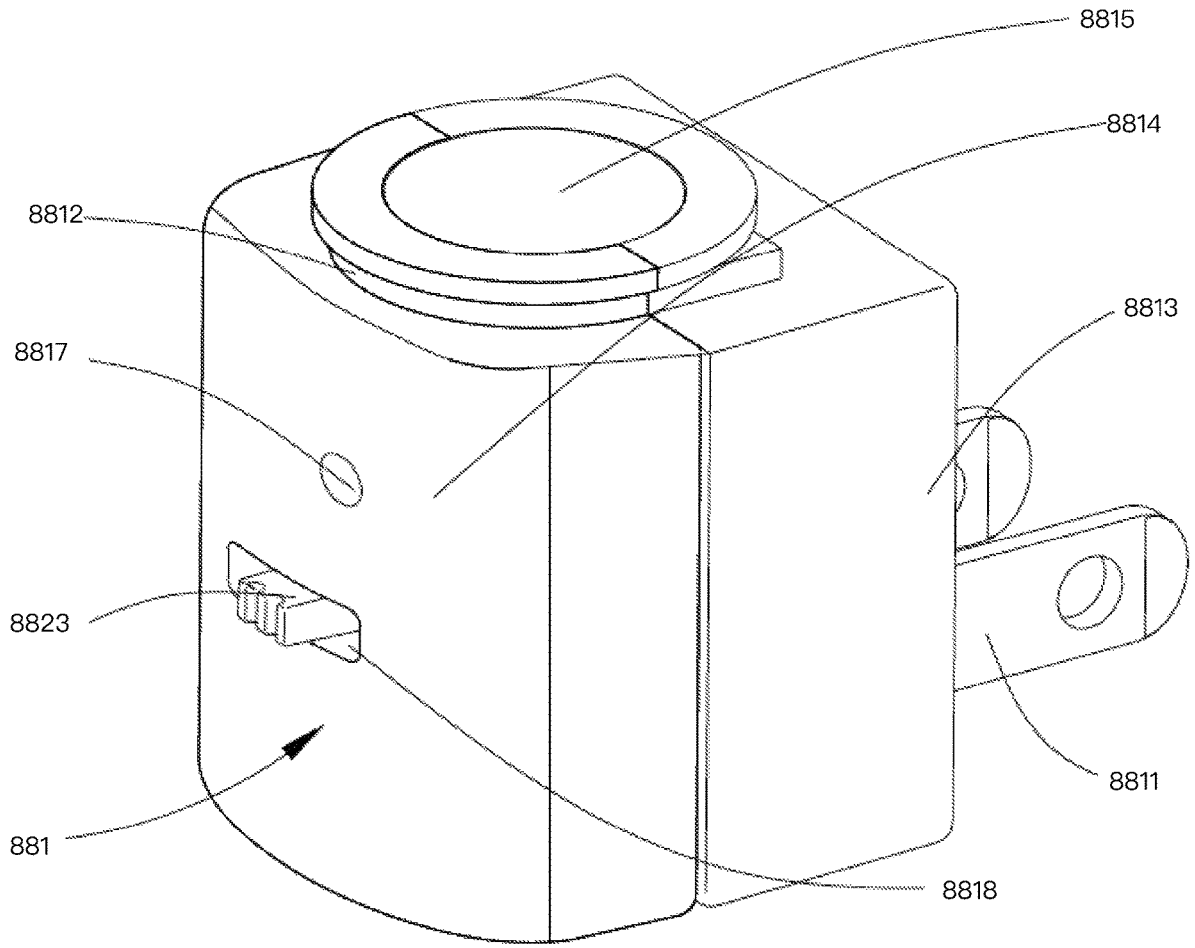
FIG. 5 illustrates a base container example.

FIG. 5 shows the lens 8815 is clipped by the neck structure 8812. There is a sensor opening 8817 for a sensor installed inside the base container 881 to detect information like motion or ambient light intensity. The manual switch 8823 via the operation opening 8818 is provided for users to operate the lighting apparatus or other devices. There is an electrical pin 8811 to receive power supply. There is a back cover 8813 and a front cover 8814 together forming the base container 881.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light source module comprising a LED module;

a driver for converting an external power source to driving current supplied to the LED module;

an electrical pin for plugging to an electrical socket to connect to the external power source;

a neck structure having a light opening and a buckle groove;

a light passing cover with a connector attached to the buckle groove, wherein a light is emitted from the LED module passes through the light opening to the light passing cover; and a base container for containing the light source module and the driver, for fixing the electrical pin to have an exposed portion to be inserted to the electrical socket, and for fixing the neck structure at an exterior surface of the base container, wherein the neck structure has an electrode for routing electricity to a second light source disposed on the light passing cover.

2. The lighting apparatus of claim 1, wherein a first direction for the electrical pin inserting to the electrical socket is perpendicular to a second direction for the LED module to emit the light passing through the light opening.

3. The lighting apparatus of claim 1, wherein the base container has a front cover and a back cover, the electrical pin is disposed on the back cover.

4. The lighting apparatus of claim 3, wherein the neck structure has a first neck part and a second neck part, the first neck part is disposed on the front cover and the second neck part is disposed on the back cover, when the front cover is fixed to the back cover, the first neck part engages the second neck part together forming the buckle groove.

5. The lighting apparatus of claim 4, wherein the first neck part has a first lens groove, the second neck part has a second lens groove, when the first neck part engages the second neck part, the first lens groove and the second lens groove together form the light opening and clip a lens at the light opening.

6. The lighting apparatus of claim 3, wherein the neck structure is detachably attached to the base container.

7. The lighting apparatus of claim 1, wherein the driver is located on a first circuit board, the electrical pin is fixed to the first circuit board, the LED module is located on a second circuit board, the first circuit board is perpendicularly fixed to the second circuit board.

8. The lighting apparatus of claim 1, wherein the light passing cover has multiple protruding bars in an inner surface of the light passing cover, a width of the protruding bar is smaller than a distance between adjacent protruding bars.

9. The lighting apparatus of claim 1, wherein the light passing cover has multiple protruding bars in an inner surface of the light passing cover, a width of the protruding bar is larger than a distance between adjacent protruding bars.

10. The lighting apparatus of claim 1, wherein a transparent cover is fixed to the light opening, the transparent cover and the base container together conceal the driver and the light source module.

11. The lighting apparatus of claim 10, wherein the transparent cover is a lens for guiding the light of the LED module into the light passing cover.

12. The lighting apparatus of claim 11, wherein the lens is a diffusion lens.

13. The lighting apparatus of claim 1, wherein the base container has a rotation structure for rotating the base container with respect to the electrical pin.

14. The lighting apparatus of claim 1, further comprising a manual switch disposed on the base container for remote controlling another light device.

15. The lighting apparatus of claim 1, further comprising an extending socket for inserting a function module, wherein the function module is electrically connected to the driver.

16. The lighting apparatus of claim 1, wherein there is a reflective layer disposed at a firs side inside the light passing cover to reflect the light of the LED module to a second side of the light passing cover.

17. The lighting apparatus of claim 1, wherein the light passing cover has an identifier unit, when the light passing cover is attached to the neck structure, the driver determines a setting according to the identifier unit to control the LED module.

18. The lighting apparatus of claim 1, wherein the passing cover has a back opening facing to a third direction in parallel to a first direction the electrical pin is inserted to the electrical socket.

19. The lighting apparatus of claim 1, wherein the base container has a sensor opening on a front surface for a sensor connected to the driver to determine a setting based on detected data of the sensor.

* * * * *